United States Patent [19]

Burdett

[11] 3,993,720

[45] Nov. 23, 1976

[54] PROCESS AND APPARATUS FOR FORMING MODULAR BUILDING STRUCTURES

[76] Inventor: Harold D. Burdett, 3802 Grandview, Tempe, Ariz. 85282

[22] Filed: Sept. 30, 1974

[21] Appl. No.: 510,507

[52] U.S. Cl. ..... 264/33; 249/20; 249/177; 249/180; 264/34; 264/336

[51] Int. Cl.[2] ..... E04B 1/16

[58] Field of Search ..... 264/33, 34, 31, 336; 249/20, 177, 180

[56] References Cited

UNITED STATES PATENTS

| | | | |
|---|---|---|---|
| 3,037,259 | 6/1962 | Dave | 264/33 X |
| 3,482,005 | 12/1969 | Quentin | 264/34 X |
| 3,689,019 | 9/1972 | Ferenc | 264/33 X |

*Primary Examiner*—Robert F. White
*Assistant Examiner*—Thomas P. Pavelko
*Attorney, Agent, or Firm*—Warren F. B. Lindsley

[57] ABSTRACT

A process and portable apparatus for forming individual or multiple reinforced concrete, hollow core units of a modular building structure in interconnected side by side and/or high rise relationship which apparatus may be sufficiently collapsed to allow for easy removal from the formed and cured hollow core unit to again be used to form additional subsequent, interconnected, hollow core units of the building structure.

5 Claims, 21 Drawing Figures

PROCESS AND APPARATUS FOR FORMING MODULAR BUILDING STRUCTURES

BACKGROUND OF THE INVENTION

This invention relates to a process and portable apparatus for forming reinforced concrete, hollow core units of a modular building structure.

Field of the Invention

This invention is particularly directed to a method of utilizing removable and reuseable inner form or cell portions of concrete forming devices for forming cells of a multi-cell building.

Description of the Prior Art

Before the disclosure of U.S. Pat. No. 3,476,351, granted Nov. 4, 1969, of which this invention is an improvement, it was necessary to hand erect and disassemble the forms required for this type of hollow core unit construction which is a very costly and time consuming operation.

Other prior art devices utilized for hollow core concrete construction have been complex mechanically actuated machines which required the transporting of extremely heavy concrete forms to a building site and the extensive use of expensive handling equipment to position these concrete forms in position in the building structure.

Summary of the Invention

In accordance with the invention claimed, an improved, inner form or cell structure has been provided for use in hollow core concrete construction which is portable and requires a minimum amount of on the job set up time.

Another object of this invention is to provide an improved, inner form or cell structure having removable, replaceable corner forming inserts that serve as filler pieces for the upper corners of the cell structure.

Still another object of this invention is to provide an inner form or cell structure having manually operable hinge means associated with said corner inserts for removing the inserts from the corners of the cell when the formed hollow core concrete unit has cured and for replacing said inserts in the corners of the cell when setting up the same for producing another unit.

A further object of this invention is to provide an inner form or cell structure having hydraulically operable cylinder means arranged to control the movement of the side walls and ceiling elements of the cell structure to provide for easy removal of the cell structure from the cured hollow core concrete unit and to again set up the cell structure for forming or producing another unit.

A still further object of this invention is to provide a plurality of vertically disposed, sectional and removable, tubular support members having height adjustable rollers at their extreme upper ends which are adapted to extend upwardly through preformed clearance holes in the top ceiling surface of the last completely cured hollow core unit to guide, align and support said cell structure in correct spaced relationship each time another hollow core unit is to be formed on top of the previously cured or finished unit.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
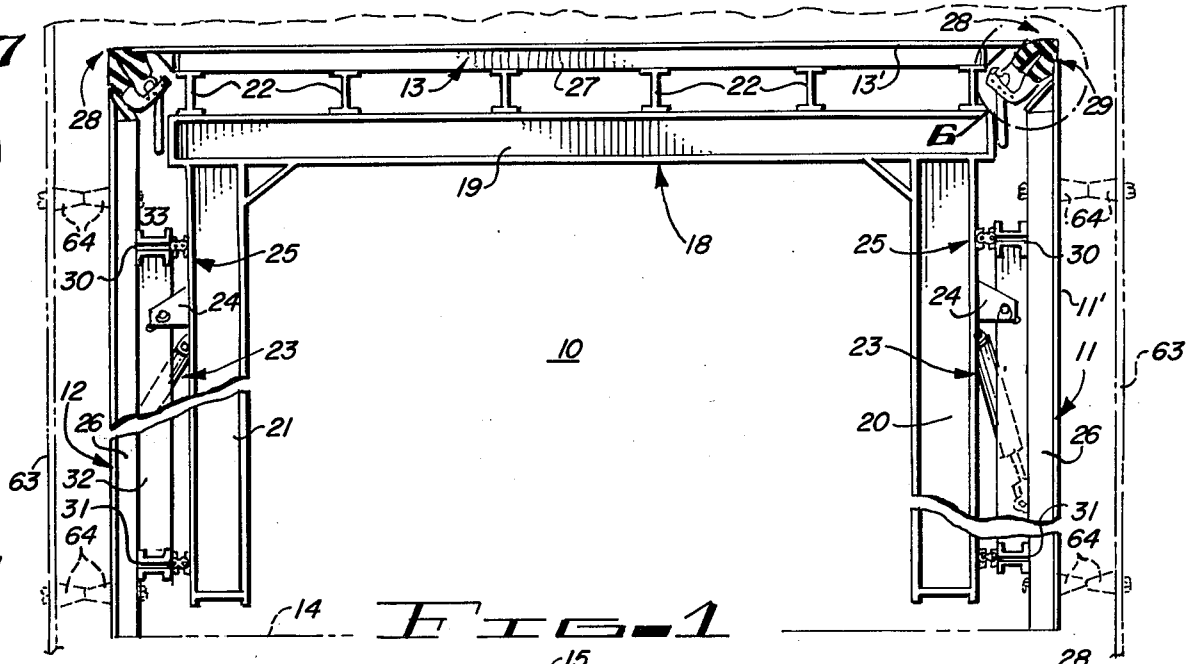
FIG. 1 is a front end elevational view of the assembled inner form or cell structure of this invention showing the side wall, ceiling and corner filler components of the device in fully expanded relationship in solid line, with the auxiliary removable side panels and their attaching means indicated in dash lines ready to receive the material to form a single, concrete hollow core unit.
Figure 2:
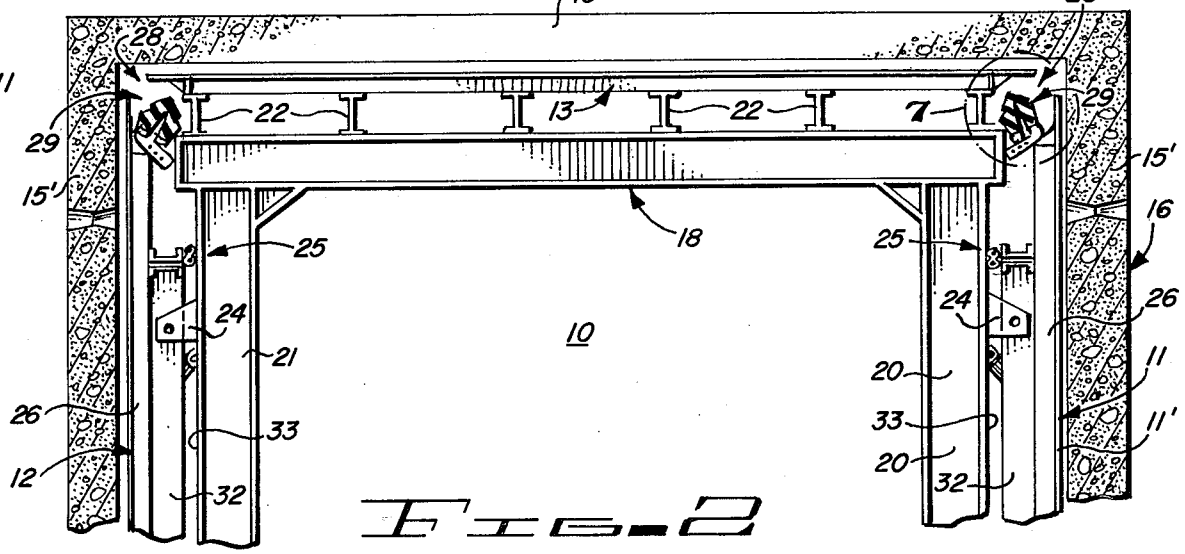
FIG. 2 is a fragmental front end elevational view of the inner form or cell structure shown in FIG. 1 illustrating the relative relationship of the side wall, ceiling and corner filler components of the device when fully contracted to allow removal of the cell structure from the finished hollow core concrete unit which has been formed.
Figure 3:
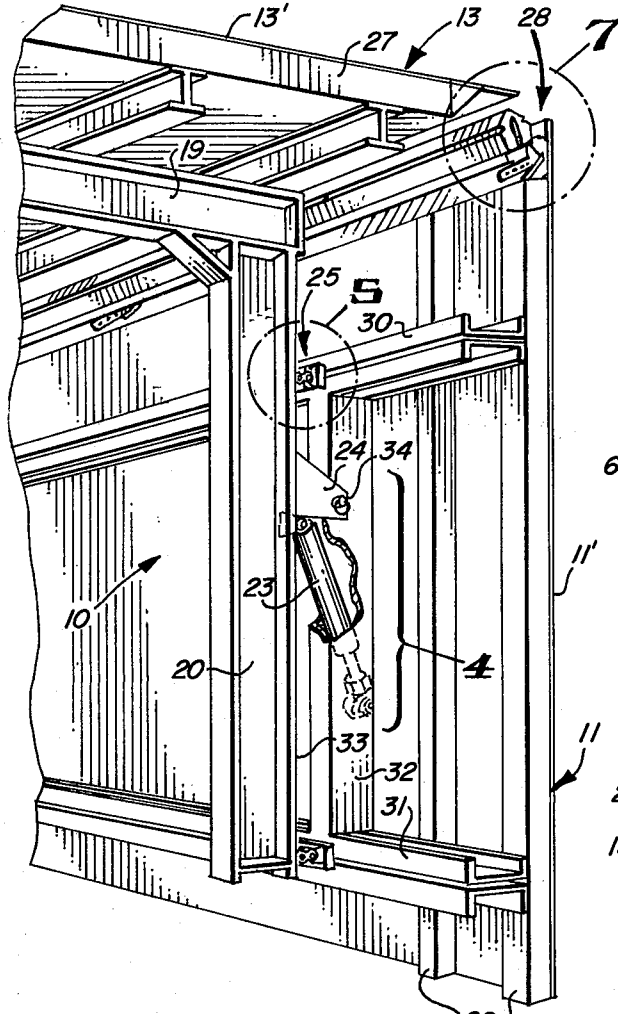
FIG. 3 is a fragmentary perspective view of the cell structure shown in FIGS. 1 and 2 with its side wall and ceiling components in fully expanded relationship as in FIG. 1, but with the corner filler components temporarily removed from the open corners to make ready for contraction of the side wall and ceiling components of the device as shown in FIG. 2.

Referring more particularly to the drawings by characters of reference, FIGS. 1, 2 and 3 disclose the assembled inner form or cell structure 10 of this invention comprising reinforced smooth outer surfaced right and left side wall assemblies 11 and 12, respectively, and a reinforced smooth outer surfaced top or ceiling assembly 13.

Figure 8:
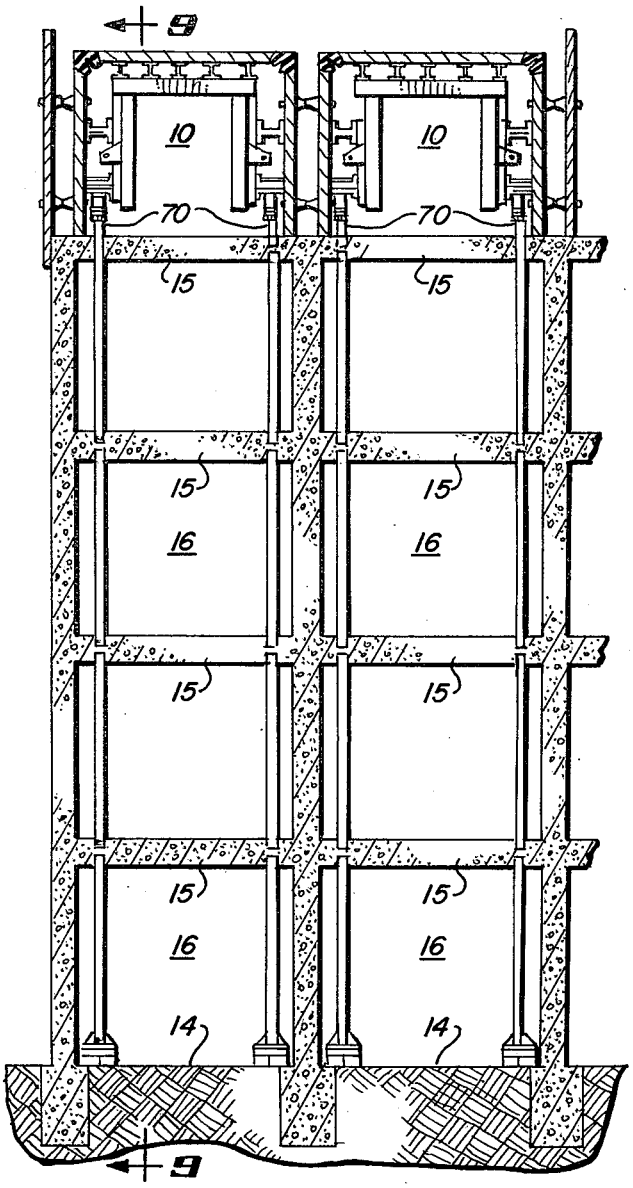
FIG. 8 is a transverse vertical sectional view of a high-rise building structure which has been built up of interconnected hollow core concrete units by utilizing the inner form or cell structure of the present invention taken substantially on the line 8—8 of FIG. 9 showing a pair of forms or cell structures supported on rollers at the top ends of a plurality of sectional tubular support members and installed together with auxilliary side panels on the finished top level of the building structure in readiness for pouring and forming another pair of hollow core concrete units.
Figure 9:
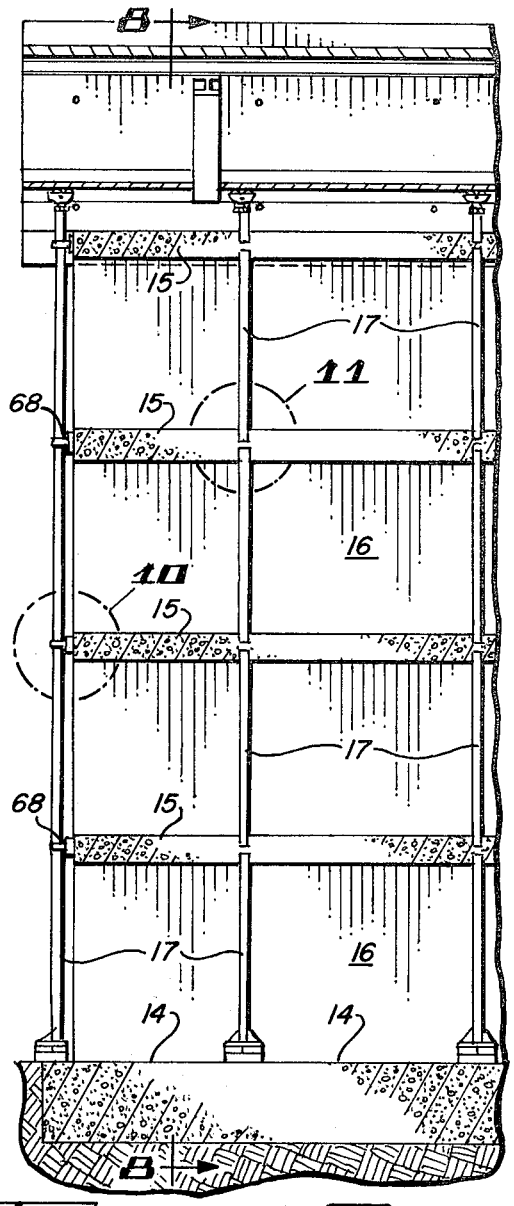
FIG. 9 is a fragmentary longitudinal vertical sectional view taken on the line 9—9 of FIG. 8 through the building structure and one of the installed and supported inner forms or cells shown in FIG. 8.
Figure 10:
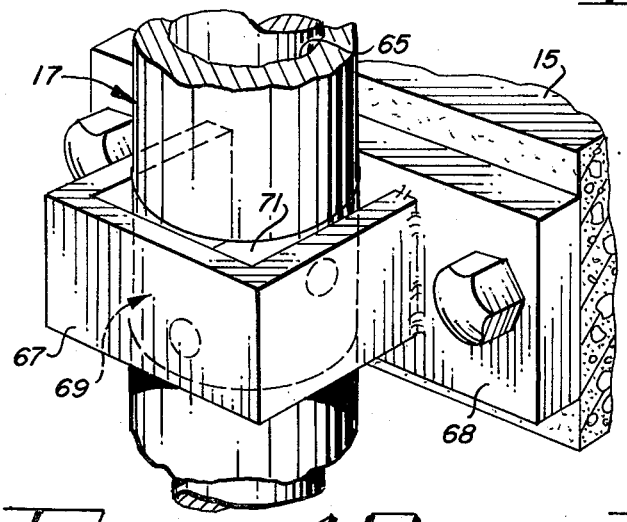
FIG. 10 is an enlarged perspective view of the area of the building structure indicated by the circle "10" at the front end of the same showing one method of guiding and retaining the tubular sectional vertically mounted cell support members on the outside of the finished portion of the structure.
Figure 11:
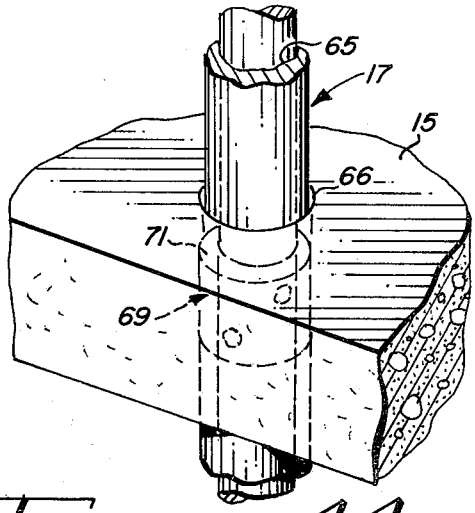
FIG. 11 is an enlarged perspective view illustrating one method of connecting together in rigid vertical relationship the sections of the support members where they pass through preformed clearance holes in the ceiling/floors of the building structure.

It should be understood that the inner form or cell structures 10 of this invention are capable of being utilized to produce a plurality of single story interconnected hollow core concrete units in side by side relationship or a plurality of similar units in high rise relationship of two or more storied structures. Therefore, when the cell structures are being set up to produce the first story of a multiple unit structure, the side walls 11 and 12 of the forms are allowed to rest on the level inner top surfaces of the previously prepared concrete footings, floor or ground surfaces, as indicated at 14 in FIGS. 1, 8 and 9 of the drawings. When being set up to produce the second and subsequent stories of the structure, the side walls 11 and 12 are supported a slight distance above the level surface of the floor/ceiling portion 15 of the finished hollow core unit 16 directly below where the assembled cell structures 10 are supported by a plurality of tubular, sectional, roller topped, removable support members 17, as shown in FIGS. 8 and 9 and the sequence FIGS. 19, 20 and 21, hereinafter explained.

Each inner form or cell structure assembly 10 includes two or more bridge like heavily constructed steel inner frame members 18, the quantity depending on the overall length of the cell structure and each inner frame consists of a horizontal tie beam 19 and a pair of depending side members 20 and 21. The frame member is preferably fabricated of standard "I-Beam" steel stock which is welded to form the perfectly squared, contiguous form which is installed in the interiors of the cell structures 10 in spaced parallel relationship to the side wall assemblies 11 and 12 and the top or ceiling assembly 13. This frame member is arranged to move or reciprocate vertically with the assemblies 11, 12 and 13 to which it is rigidly secured by longitudinally disposed parallel I-beams 22. These I-beams 22 extend between the inner surface of the ceiling assembly over and beyond the horizontal top surfaces of the bridge like inner frame members 18. The depending vertical side members 20 and 21 are movably associated with the side wall assemblies 11 and 12 by pairs of hydraulic cylinders 23, pairs of outwardly extending angle brackets 24 having removable pins, and pairs of pivoting link and bracket assemblies 25.

The side wall assemblies 11 and 12 and the top or ceiling assemblies 13 are preferably fabricated of heavy gauge steel plates 11′, 12′ and 13′, respectively, that are perfectly flat and smooth on their outer surfaces having welded thereto on their inner surfaces a plurality of equally spaced, parallel vertical or horizontally disposed reinforcing ribs 26 and 27. These ribs are somewhat shorter in their vertical lengths and horizontal widths than the side plates 11′ and 12′ and the ceiling plate 13′ to which they are welded with the side plates extending upwardly beyond the top ends of the reinforcing ribs 26 a predetermined distance. The ceiling plate is just wide enough to extend a similar distance beyond the ends of the horizontal ribs 27 to provide an equal sided right angle opening or vacated space 28 which extends the full length of the inner form or cell 10 when the same is in either its fully expanded or contracted position to allow for the manual insertion or removal of the longitudinal segments of suitable split, flexible, corner filler pieces 29 into or out of the right angle openings 28. The filler pieces are provided to square off and close the corner openings in preparation for the forming of a hollow core concrete unit and to allow for removal of the inner form or cell from the formed unit when the concrete is set.

Attached by welding to the inside flat surfaces of the vertical reinforcing ribs 26 in horizontal, parallel relation to each other, are the upper and lower pairs of channel or I-beam members 30 and 31 which extend longitudinally the full length of the side wall assemblies 11 and 12. These channel or I-beam members become an integral part of the side wall assemblies and together with suitable, box section vertical members 32 interposed between the upper and lower channel members and welded thereto in direct parallel and transverse alignment with each of the depending vertical side members 20 and 21 of each inner frame member 18, serve to stiffen and reinforce the side wall assemblies 11 and 12 and provide the necessary spaced relationship between the depending vertical side members 20 and 21 of the frame 18 for the installation and operation of the previously mentioned connecting elements. These elements include the hydraulic cylinders 23, angle brackets 24 and the pivoting link and bracket assemblies 25 which provide the means for causing the inward contraction and outward expansion of the side wall assemblies, when desired.

Figure 4:
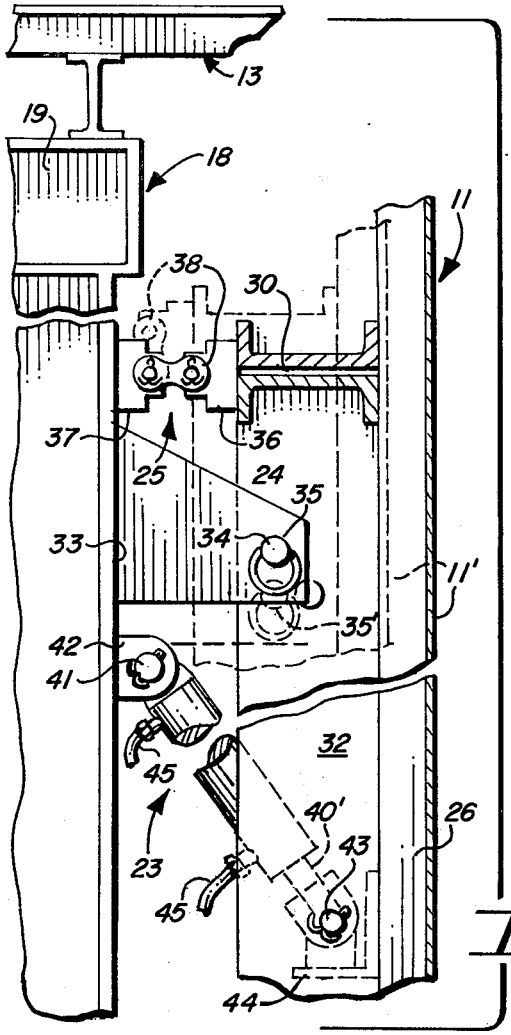
FIG. 4 is an enlarged fragmentary front and elevational and sectional view taken in the area as indicated by the bracket "4" in FIG. 3, illustrating more clearly the means for causing the expansion and contraction of the side wall and ceiling components of the cell.

The outwardly extending angle brackets 24 are preferably of U-shape having parallel, upwardly extending side walls and a cutout or bifurcated bottom connecting portion which allows the side walls to straddle in close relationship the side walls of the rigid vertical box section members 32. These brackets are welded or otherwise secured at their inner ends to the outer flat faces 33 of the depending vertical side members 20 and 21 of the frame members 18 in horizontal aligned relationship to each other as shown in FIGS. 1, 2 and 4 of the drawings. The side walls of angle brackets 24 are disconnectably connected in rigid relationship to the vertical box sections 32 by means of removable pull pins 34 that extend through horizontally aligned mating apertures 35 in the side walls of the angle brackets 24 and the side walls of the vertical box section members 32 when the side wall assemblies 11 and 12 are in their fully expanded position shown in FIG. 1 and 4. These pins may be removed and replaced in similar horizontally aligned apertures 35' in the side walls of the vertical box section members that are located to receive the pull pins 34 when the side wall assemblies 11 and 12 are in their fully contracted position shown in FIG. 2 and in dash lines in FIG. 4.

Figure 5:
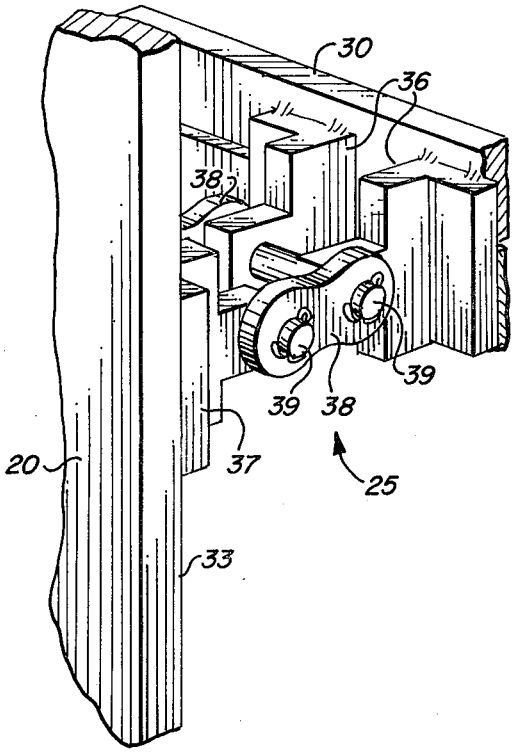
FIG. 5 is a greatly enlarged perspective view of the linkage connection between the side walls and the vertically movable bridge ceiling support element which partly controls the expansion and contraction of the side walls taken in the area indicated by the circle "5" in FIG. 3.

The pairs of upper and lower pivoting link and bracket assemblies 25 utilized to assure and limit the parallel in and out movement of the side wall assemblies 11 and 12 during the expansion and contraction of the inner form or cell structure 10, consist of suitable pairs of dog-leg brackets 36 and 37. The inner brackets 37 are securely welded to the outer flat faces 33 of the depending vertical side frame members 20 and 21 in horizontal alignment with each other and the outer aligned brackets 36 are securely welded to the inner faces of the upper and lower pairs of channel or I-beam members 30 and 31, respectively. The opposed extensions of the pairs of dog leg brackets 36 and 37 are connected together in pivoting relationship by pairs of suitable links 38. Links are journaled on the outer ends of pins 39 that extend through the opposed extensions of the dog leg brackets and are adapted to assume the in-line position shown in fill line in FIg. 4 and 5 when the cell structure is in its expanded position and to assume the vertical position as indicated in dash lines in FIG. 4 when the cell structure is in its contracted position.

The pairs of hydraulic cylinders 23 used to provide the necessary reciprocating up and down movement of the bridge like inner frame members 18 and hence the top or ceiling assembly 13 of the cell structure to which it is rigidly attached, also provide for the in and out movement of the side wall assemblies 11 and 12. This in and out movement of wall assemblies 11 and 12 occurs by virtue of their relative association with the link and bracket assemblies 25 described above. To accomplish this function, the cylindrical casing portions 40 of the hydraulic cylinders are pivotally attached to the outer flat vertical faces 33 of the depending side members 20 and 21 of frame member assemblies 18 by pins 41 which are inserted in the end eyes of the cylinder casing and apertures formed in the brackets 42 which are welded in horizontal relationship to the outer faces 33 of the depending vertical side members 20 and 21.

All of the hydraulic cylinders 23 are mounted in parallel angular relationship with the vertical centers of the outer flat surfaces 33 of the depending side frame members 20 and 21 and the vertical centers of the box section members 32. Members 32 are cut out on their inner faces to allow entry of the cylinders and their piston shafts 40' in working relationship with the interior of the box section members 32 where they are secured in pivoted relationship by removable pins 43. These pins extend through apertures in the sides of the box section members, mating eyes formed on the adjustable ends of the piston shafts 40' and the stationary ears formed on a suitable bracket 44 welded to the inner sides of the box section members 32 and to the inner faces of the aligned vertical reinforcing ribs 26 as shown in FIG. 4.

Each of the hydraulic cylinders are provided with the usual pressure hoses 45 which are attached with suitable fittings to the cylinders and to other pressure hoses or hydraulic lines (not shown) that are attached to the inside faces of the vertical reinforcing ribs 26 of the side wall assemblies 11 and 12. These hoses extend to a suitable control valve (not shown) and thence to a suitable pressure source, positioned closely adjacent to but outside of the interior of the cell structure 10.

It should be evident with this arrangement of hydraulic pressure hoses, lines and control valve that when hydraulic fluid under pressure is allowed to enter simultaneously cylinder casings 40 at their lower ends behind their respective pistons that their respective points of pivot (pins 41 and 43) will be forced into closer relationship to each other, thereby causing the inner frame member assemblies 18 with the integrally attached ceiling assembly 13 to be lowered. This action causes all of the links 38 of the link and bracket assemblies 25 to be pivoted about their inner pins 39 on which they are journaled simultaneously, resulting in the forced inward movement or contraction of the side wall assemblies 11 and 12 to which the pivoting link and bracket assemblies 25 are attached.

It should be noted that before the above described action could take place, it would be necessary to remove all of the pull pins 34 from the aligned apertures 35 in the vertical box section members 32 of the side wall assemblies and reinsert them again in the apertures 35' when the contraction of the ceiling and side wall assemblies has been completed. Should it be desired to return the ceiling and side wall elements of the cell to their fully expanded position, the pull pins 34 would again be removed from the aligned apertures 35' and the hydraulic control valve actuated to allow fluid under pressure to enter the cylinder casings 40 at their upper ends in front of their respective pistons to thereby force their points of pivot (pins 41 and 43) further apart causing the inner frame member assemblies 18 with the integrally attached ceiling assembly 13 to be raised. This action results in reverse movement of the link and bracket assemblies 25 causing the side wall assemblies 11 and 12 to move outwardly into their fully expanded position. At this time, the pull pins 34 would be reinserted in the aligned apertures 35 in the vertical box sections 32 to maintain the ceiling and side wall elements of the cell in their expanded position.

With the ceiling and side wall elements of the inner form or cell structure 10 in their expanded position, the next procedural step for preparing the cell structure for producing a hollow core concrete unit such as 16 is to manually insert the split flexible corner filler pieces 29 in locked position in the right angle openings or vacated spaces 28 formed at the upper corners of the cell structure. This is readily accomplished as follows:

The corner filler pieces 29 are preferably formed or fabricated in two or more identical segments or lengths since a single length of the same which might be as long as 30 feet would be extremely difficult to handle by workmen preparing the cell for production of a concrete unit.

The segments or length of corner filler pieces 29, preferably about 10 feet long, are adapted to abut each other in horizontal alignment comprising an extruded section of rubber or other semi-flexible material having a central angular split or division 46 which does not extend quite to the apex 47 of the filler piece. This split divides the body of filler piece 29 into two radially inwardly projecting legs 48 each having flat bottom end surfaces 49 to each of which is securely attached by studs and nuts 50, metallic right angle pieces 49' which extend the full length of the corner filler pieces 29.

Figure 6:
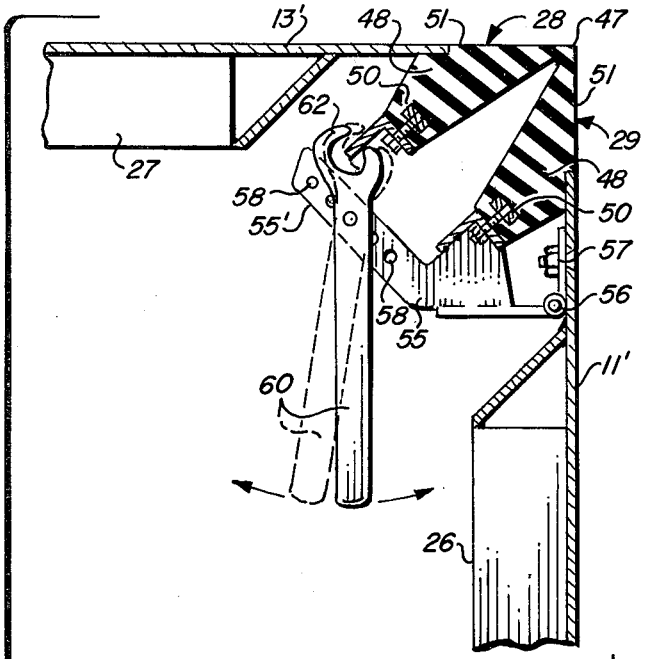
FIG. 6 is an enlarged sectional view taken in the area of the circle "6" in FIG. 1 illustrating the relationship of the corner filler components to the opening between the side wall and ceiling elements of the cell when fully expanded.
Figure 7:
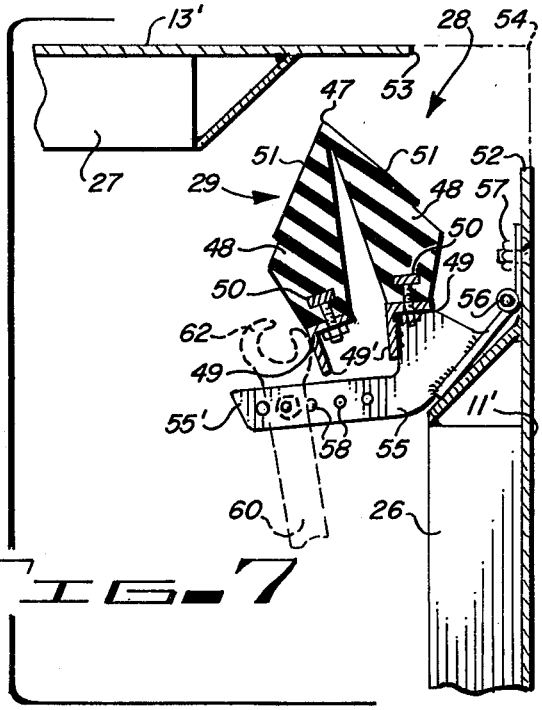
FIG. 7 is an enlarged sectional view similar to FIG. 6 taken in the area of the circle "7" in FIGS. 2 and 3 illustrating the respective relationship of the corner filler components to the opening between the side wall and ceiling elements of the cell when removed to allow for contraction of these elements.

The radially extending outer sides 51 of the corner filler pieces are smooth and flat and are formed to provide two separate parallel plane surfaces on each side of its apex 47. The longer surface is exactly the same in width dimension as the vertical and horizontal distances of the open space 28 measured on these planes from the top edges 52 of the respective side wall plates 11' and 12' and the side edges 53 of the ceiling plate 13' to the imaginary corner or apex 54 of the plates if they were extended to meet, as indicated in FIG. 7 of the drawings. This point becomes the true apex 47 of the corner filler piece when the radially extending outer side surfaces 51 of the same are snapped into contacting relationship with the edges 52 and 53 of the respective side and ceiling plates thus completely filling the 90° open corners 28 as clearly illustrated in FIG. 6.

It should be understood that the corner filler pieces 29 are only utilized to temporarily square off and fill the openings 28 at the upper corners of the inner form or cell 10 when the same is in its fully expanded position for the forming of a hollow core concrete unit. After curing of the concrete, these pieces are removed from openings 28 before the ceiling and wall elements of the cell can be drawn in or collapsed as previously described.

To accomplish this function, the outside angle piece 49' is welded securely in two or more locations along its length to one of the edge surfaces of a like number of suitably formed manipulating plate members 55, an opposed edge of which is securely welded to the lower leaves of a like number of hinge members 56. The upper leaves of hinge members 56 are secured by bolts and nuts 57 to side plates 11' and 12' at a location which is slightly above the top ends of the vertical reinforcing ribs 26. The right angle extensions 55' of the manipulating plate members are each provided with a plurality of suitably spaced clearance holes 58 in any one of which a pin 59 laterally spaced in the handle portion 60 of a manipulating tool or wrench 61 may be inserted. The cam like jaws of the head portion 62 may then contact either side of the projecting leg of the unincumbered angle piece 55', as shown in FIG. 7 to be used by workmen at a number of points along the filler piece simultaneously to apply sufficient leverage with an upward push and pivoting movement of the pin 59 to spread the projecting legs 48 of the filler piece 29 apart and snap the same and the entire segment of the split corner filler piece into the opening or vacating space 28 as clearly shown in FIG. 6. This procedure is continued until all the segments of the filler pieces are installed in abuting relationship in the open corners on both sides of the expanded cell.

To remove the filler pieces 29 from the corner openings 28 when it is desired to collapse or contract the cell for removal of the same from a finished hollow core concrete unit, it is only necessary for the workmen to again utilize the manipulating tool 61 with its pivot pin 59 inserted in any one of the clearance holes 58 in the plate member 55 to reverse the above described procedure by pulling down on the same and applying pressure to the leg of the angle piece 49' to partially close the split 46 in the filler piece 29. This action snaps it out of the corner openings 28 and lets it drop by gravity to assume the position shown in FIG. 7 at which time the manipulating tools 61 may be removed or left hanging in one of the clearance holes 58 until needed for future use.

When the building project calls for the construction of single or multiple width side by side hollow core concrete units of either one or several stories high, the inner form or cell structures of the present invention are set up or installed in parallel spaced relationship so that the opposed smooth outer surfaces of the side plates of the side wall assemblies 11 and 12 are spaced apart the required distance to form the interconnecting interior, vertical dividing walls 15' of a specified thickness. In order to form the outside vertical side walls of the end units, it is necessary to utilize supplemental forms of any suitable type having smooth surfaced vertically mounted steel plates 63 (indicated in dash lines in FIG. 1) which are temporarily attached to side wall plates 11' and 12' of the side wall assemblies by means of removable bolts or studs which are threaded through the respective vertical plates from both sides thereof into the threaded bores of a plurality of nonremovable conical spacers 64. These spacers are adapted to support and space the vertical steel plates 63 of the supplemental forms in parallel relationship the required distance from the vertical steel plates 11' and 12'.

When the particular hollow core concrete units of the building structure are cured, these forms can quickly be removed from their described attachment to the side plates 11' and 12' of the side wall assemblies of the cell structure by simply removing the bolts or studs from the plates and conical spacers 64. Spacers 64 remain in the finished concrete walls to serve as additional reinforcement.

The inner form or cell structures 10 of the present invention may be utilized to form the hollow core units of a high rise or several storied building structure and the difficult task of setting up or installing the cell structures on the top surface of the finished floor/ceiling portion 15 of the concrete units in proper aligned and spaced relationship for forming the next several stories of the building structure has been simplified by this invention. A multi story building may be formed utilizing a plurality of tubular, sectional, roller topped support member assemblies 17, the detailed preferred construction and other features of which are illustrated in FIGS. 10, 11, 12, 13, 14, 15 and 16 of the drawings.

Each of the support member assemblies 17 comprise one or more sections of heavy duty tubular steel pipe of the same length, having finished central bores 65 which extend throughout the length of the sections. Each section is preferably just long enough to extend vertically a short distance into the horizontal floor/ceiling portions 15 of the several storied building structure as shown in FIGS. 8, 9, 10 and 11 of the drawings. Vertical clearance holes 66 have been previously formed in the extending loop portions 67 of the support guide brackets 68 which have been secured to the front ends of the floor/ceiling portions of the finished units of the building structure.

If the building structure is to be two or more stories high one section of pipe is utilized for each story and they are connected together in removable vertical aligned relationship at the approximate horizontal center of each floor/ceiling portion 15 of the building structure by suitable connector members 69. These connector members consist of short pieces of solid cylindrical steel rods 70, the diameter of which is slightly less than the central bores 65 of the tubular sections of the support members in which they are adapted to be inserted and separated by a bushing 71 having the same outside diameter as the pipe sections. The bushings are rigidly secured in fixed relationship by pins and/or welding to the short solid pieces of steel rod 65 midway between their ends as especially shown in FIG. 11 where it acts as a stopper divider between the opposed ends of the pipe sections in the bores of which the respective ends of the short solid steel rods 65 extend. The steel rods 65 form the vertical support portion of the sectional roller topped support member assemblies 17 which pass through the preformed vertical clearance holes 66 in each floor/ceiling level 15 of the structure and which may be easily removed when no longer required by simply disassembling the sections of pipe after pulling the same up and out of the clearance holes 66 from the finished top level of the structure.

Figure 12:
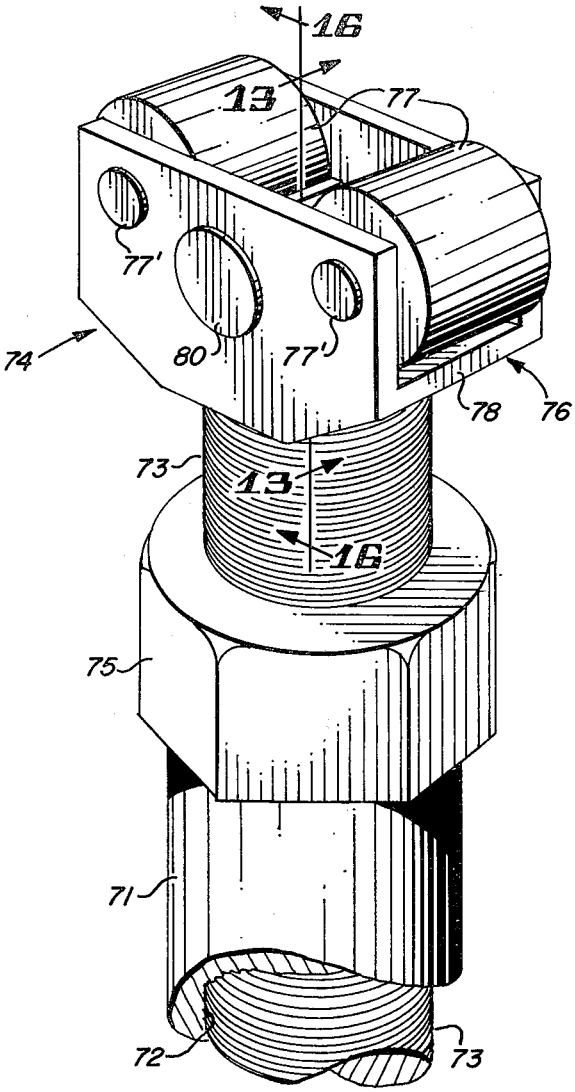
FIG. 12 is an enlarged fragmentary perspective view illustrating one method of connecting the height adjustable roller bracket assemblies in removable relationship to the top end of the uppermost section of the sectional tubular support members.
Figure 13:
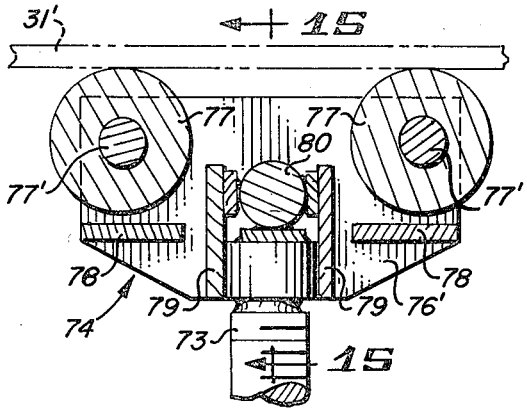
FIG. 13 is a vertical sectional view taken on line 13—13 of FIG. 12 showing the relationship of the rollers to the supporting components of the height adjustable bracket assembly of FIG. 12.
Figure 14:
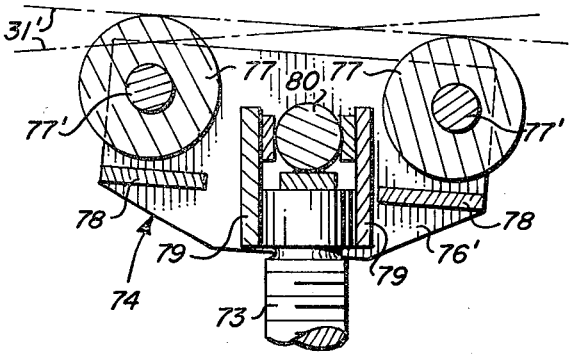
FIG. 14 is a sectional view similar to FIG. 13 showing the roller and bracket components of the assembly in tilted relationship to the vertical support components of the same.
Figure 15:
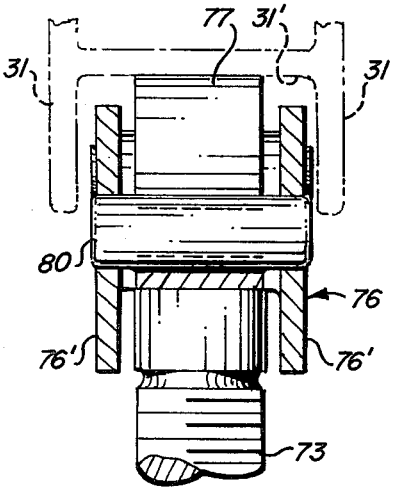
FIG. 15 is a transverse sectional view taken on line 15—15 of FIg. 13 showing one means of allowing for the tilt of the rollers and bracket relative to the rigid vertical support components of the assemblies.
Figure 16:
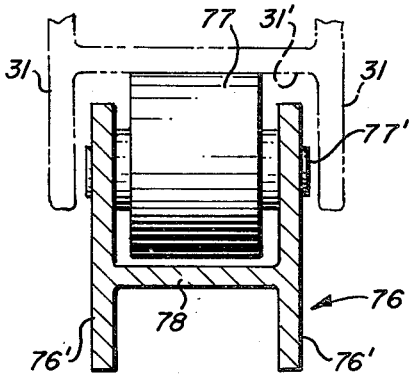
FIG. 16 is a transverse sectional view taken substantially on line 16—16 of FIG. 12 showing the normal relationship between the rollers of the eight adjustable bracket assemblies when supporting one of the inner form or cell structures on the longitudinal lower channel members (shown in dash line) of the same.

In order to receive and position the inner form or cell structures 10 in parallel alignment, level relation above the top floor/ceiling portions 15 of the finished structure, the interconnected sections of the vertical tubular support members are provided with comparatively short pipe extensions 71 which extend slightly above the top surface of the finished floor/ceiling level. These pipe extensions have the same outside diameters and central bores as the pipe section to which they are removably attached in vertical relationship by the connector members 69. At least half the length of their central bores are provided with female threads 72 which are adapted to receive the male threaded stem extensions 73 of the roller bracket assemblies 74 in height adjustable relationship therewith as shown in FIG. 12 of the drawings. The bracket assemblies 74 may be held in their adjustable relationship by means of suitable lock nuts 75 which are threaded onto the stem extensions 73.

The roller bracket assemblies 74 comprise the male threaded stem extensions 73 and the inverted "H" shaped roller support brackets 76 having parallel vertical walls 76′ between which a pair of identical rollers 77 are journaled on suitable pins 77′. These pins are fixed to and extend through the walls of the roller support brackets 76. The transverse, horizontal cross members 78 which integrally join the vertical walls 76 of the roller support brackets 76 are cut away a sufficient distance to allow for the insertion of the transversely extending vertical and parallelly positioned pair of upstanding flat plate members 79. These plate members are welded to the perimeter of the unthreaded top cylindrical portions 73′ of the threaded stem extensions 73 but do not contact the vertical side walls 76′ of the roller support brackets 76 to provide the sometimes necessary tilting movement of said brackets relative to the vertical stem extensions on which they are mounted.

To provide the means for allowing the above described tilting action of the roller support bracket the vertical side walls 76′ are secured to the outer ends of a centrally located pin 80 which extends through apertures in the side walls as shown. Pin 80 is adapted to contact in a bearing and supporting relationship the top and inner side surfaces of the transversely extending base plate or pad 81 that is welded to the top flat surface of the unthreaded top portion 73′ of the stem extension 73 and to the top inner sides of the transversely extending vertical, parallel plate members 79, as shown in FIGS. 13, 14, 15, and 16 of the drawings. Thus, the roller support brackets 76 with their rotatable rollers 77 and their support pins 80 may be tilted without affecting the vertical relationship of the threaded stem extrusions 73 or the short pipe extensions 71 in which they are adjustably mounted and secured.

The roller bracket assemblies 74 are adjusted vertically in relationship to the top finished floor/ceiling surface of the building structure so they all extend an equal distance above said surface. The inner form or cell structures 10 are lifted up by any suitable handling equipment such as the transporter trailer 82, shown in the sequence FIGS. 17 through 21 of the drawings for the forming the second story units or by heavy duty cranes (not shown). This equipment places the cell structures directly on the plurality of roller topper support assemblies 17 with rollers 77 contacting the underside surfaces 31′ of the lower pairs of channel or I-beam members 31 on which the assembled cell structures 10 rest in the proper aligned parallel and height relationship until such time as the forming and curing of the hollow core concrete units is completed.

After the hollow core units 16 are cured, the cell structures 10 may be collapsed and lifted from its resting place on the rollers of the vertical sectional support member assemblies 17 and placed on the horizontal carrier bars 83 of the transporter trailer 82 for movement to another site for further use. It should be noted that during the lifting and removal of the cells from their roller supports, they are raised slightly higher at one end than the other thus possibly damaging the roller asssemblies or their vertical support members and to avoid such damage, the tilting feature provided for the roller bracket assemblies 74, previously described, compensate for the tilting of the cell structures thereby preventing damage to the respective components of the vertical support member assemblies 17.

Figure 17:
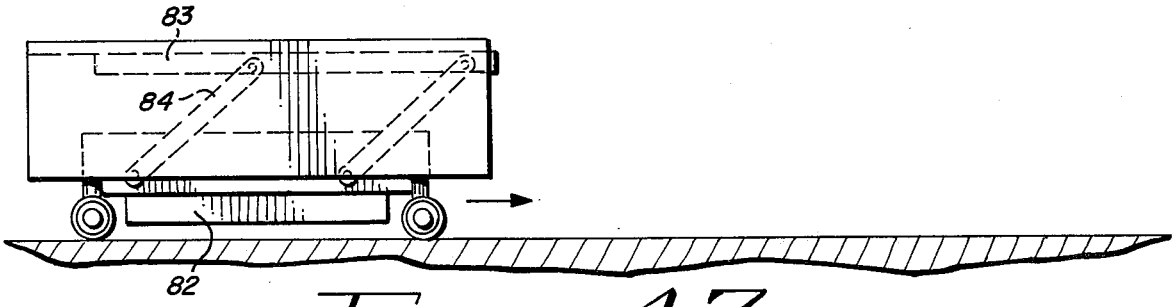
FIG. 17 is the first of five diagrammatically illustrated side elevation sequence views which shows a mobile specially constructed heavy duty trailer or transported with one of the inner forms or cells of this invention mounted thereon being moved to the construction site.
Figure 18:
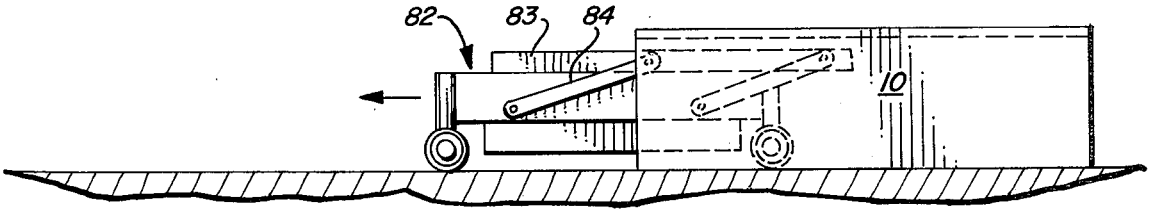
FIG. 18 shows the transporter moving out and away from the cell after the same has been set up on the ground surface ready to form a hollow core concrete unit.
Figure 19:
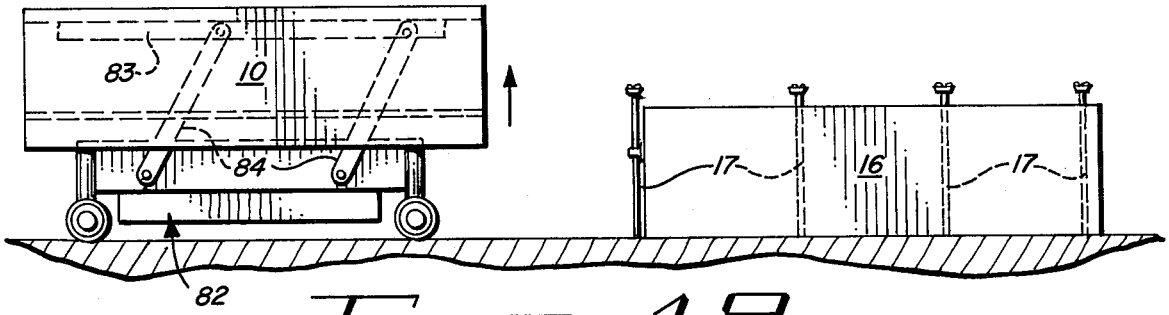
FIG. 19 shows the transporter after having lifted the cell from the finished concrete unit, moved out and away from the same, at which time one section of a plurality of tubular roller ended vertical support members are installed in the unit, as shown.
Figure 20:
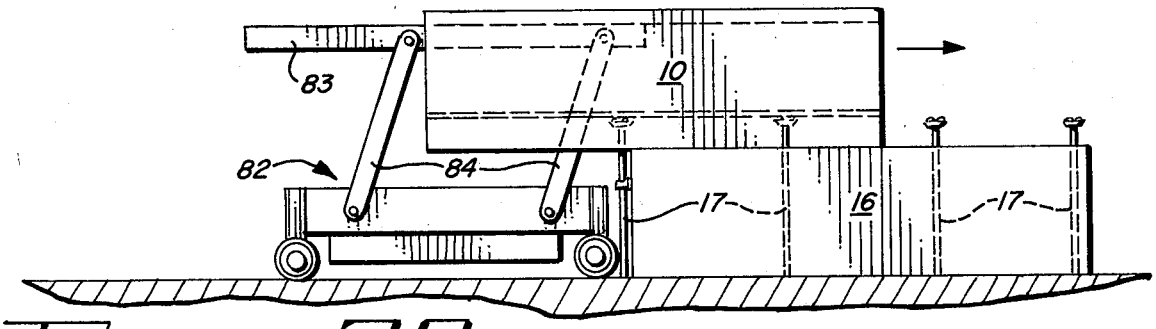
FIG. 20 shows the transporter moving the cell to the second story, allowing it to rest on the rollers of the tubular, vertical support members in position to form the second concrete hollow core unit.
Figure 21:
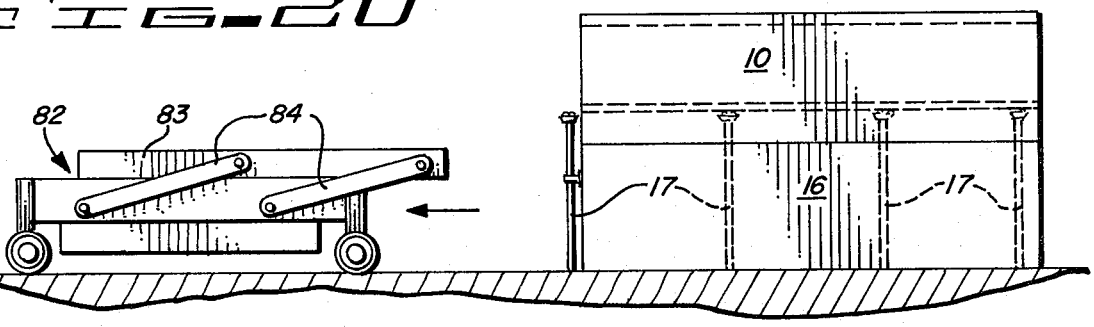
FIG. 21 shows the cell positioned in place and the transporter removed.

Should the building structure requirements be only two stories, the transporter trailer 82 may be utilized for moving the cell structures to the construction site and placing the same on level prepared ground or other surfaces for the forming of the first floor units, as illustrated in FIGS. 17 and 18 of the sequence views. When these first floor units have been cured or finished, it lifts the collapsed cell from the finished unit as illustrated in FIG. 19. At this time, one section of the roller topped support members 17 may be installed in the finished units and the transport trailer 82 by means of its pairs of pivoted lifting arms 84 and its horizontal carrier bars 83, may lift the cell structure 10 to the second floor level and place it on the roller assemblies at the top of the installed vertical support members 17 for the forming of the second floor units as shown in FIG. 20 and then subsequently removing it from the cell structure as shown in FIG. 21.

It should be recognized that the disclosed invention eliminates building failures by avoidance of the hazardous construction methods of the prior art wherein they use the underside structure to suppport the forces generated by the weight of the wet concrete mass of the added structure. The claimed method and apparatus herein places the weight of the concrete form as well as the concrete mass directly on the roller means which is transferred directly to the ground thus eliminating any possibility of loading the previously placed structure.

Although but one embodiment of the invention has been shown and described, it will be apparent to those skilled in the art that various changes and modifications may be made therein wthout departing from the spirit of the invention or from the scope of the appended claims.

What is claimed is:

1. A method of forming a multi-story building formed from similar hollow core castings comprising the steps of:

placing an expandable and collapsible form for forming the inner core of a hollow concrete structure in place in a predetermined position, forming and curing a pliable concrete mass around the sides and top of said core, collapsing and removing said core from around the cured concrete mass, positioning a first group of ground supported supports vertically within said mass so as to extend through said top of said mass a given distance, mounting roller means on the top ends of said first group of supports, raising said core above the top of said mass and positioning it on said roller means and moving it over said top until it is in position over said cured mass to be used to form a contiguous hollow core casting on top of the cured concrete mass, said supports, solely supporting the weight of the form thereby avoiding loading of the cured concrete mass prematurely, forming and curing a second pliable concrete mass around the sides of said core contiguous with the sides of said cured concrete mass and on top of said core, and when the building is completed, removing said supports.

2. The method of forming a multi-story building set forth in claim 1 in further combination with the steps of:

collapsing and removing said core from around the second cured concrete mass, removing said roller means from the first group of supports, mounting a second group of supports one on top of each of said first group of supports and causing them to extend through the top of the second cured concrete mass, and mounting said roller means on the free ends of said second group of supports.

3. A method of forming a multi-story building formed from similar hollow core castings comprising the steps of:

placing an expandable and collapsible form for forming the core of a ground supported holow concrete structure in place in a predetermined position, forming and curing a ground supported pliable concrete mass around the sides and top of said core, positioning a group of ground supported supports vertically within said mass so as to extend through said top of said mass a given distance, collapsing and removing said core from around the cured concrete mass, raising said core above the top of said mass and positioning it on said ground supported supports over said cured mass to be used to form a contiguous hollow core casting on top of the cured concrete mass, said supports solely supporting the weight of the form thereby avoiding premature loading of the cured concrete mass, forming and curing a second pliable concrete mass around the sides of said core contiguous with the sides of said cured concrete mass and on top of said core and supported by said ground supported supports, thereby eliminating loading of the previously placed ground supported pliable mass, and when the building is complete, removing said supports.

4. The method of forming a multi-story building set forth in claim 3 wherein:

said group of ground supported supports are positioned within said mass after collapsing and removable of said core from around the cured concrete mass.

5. A method of forming a multi-story building formed form similar hollow core castings comprising the steps of:

placing an expandable and collapsible form for forming the inner core of a ground supported hollow concrete structure in place in a predetermined position, forming and curing a ground supported pliable concrete mass around the sides and top of said core, collapsing and removing said core from around the cured concrete mass, positioning a group of ground supported supports vertically within said mass so as to extend through said top of said mass a given distance, mounting roller means on the top ends of said group of supports, said supports solely supporting the weight of the form thereby avoiding premature loading of the cured concrete mass, raising said core above the top of said mass and positioning it on said roller means and moving it over said top until it is in position over said cured mass to be used to form a contiguous hollow core casting on top of the cured concrete mass, forming and curing a second pliable concrete mass around the sides of said core contiguous with the sides of said cured concrete mass and on top of said core and supported by said ground supported supports, thereby eliminating loading of the previously placed ground supported pliable mass until the core and rollers are removed, and when the building is complete, removing said supports.

* * * * *